United States Patent [19]

Rubinshtein

[11] Patent Number: 4,895,464

[45] Date of Patent: Jan. 23, 1990

[54] WIRE MATRIX PRINT HEAD ASSEMBLY

[75] Inventor: Bernard Rubinshtein, Spokane, Wash.

[73] Assignee: Output Technology Corporation, Spokane, Wash.

[21] Appl. No.: 219,989

[22] Filed: Jul. 14, 1988

[51] Int. Cl.[4] ..... B41J 3/12

[52] U.S. Cl. ..... 400/124; 101/93.05; 335/266

[58] Field of Search ..... 400/121, 124, 157.2, 400/157.3; 101/93.03, 93.04, 93.05, 93.29; 335/266, 267, 268, 277, 281

[56] References Cited

U.S. PATENT DOCUMENTS

| | | | |
|---|---|---|---|
| 4,051,941 | 10/1977 | Hebert | 400/124 |
| 4,214,836 | 7/1980 | Wang | 400/124 |
| 4,218,148 | 8/1980 | Matachke | 400/124 |
| 4,382,701 | 5/1983 | Davenport | 400/124 |
| 4,737,042 | 4/1987 | Hayashi et al. | 400/124 |
| 4,840,501 | 7/1988 | Wong et al. | 400/124 |

FOREIGN PATENT DOCUMENTS

| | | | |
|---|---|---|---|
| 36540 | 9/1981 | European Pat. Off. | 400/124 |
| 83049 | 4/1986 | Japan | 400/124 |

OTHER PUBLICATIONS

W. Hasler et al., "Print Hammer"; *IBM Technical Disclosure Bulletin;* vol. 25, No. 9, pp. 4901–4902; Feb. 1983.

Anonymous; "High Performance, One-Piece Print Actuator"; *IBM Tech Disc. Bull.* vol. 28, No. 12, pp. 5296–5298, May 1986.

*Primary Examiner*—David A. Wiecking

*Attorney, Agent, or Firm*—Wells, St. John & Roberts

[57] ABSTRACT

A preferred embodiment of a wire matrix print head assembly 10 is described having a housing 16 supporting a plurality of print wires 22 that are capable of moving between retracted nonprint positions and extended print positions for printing indicia onto a print medium. The assembly has a plurality of electromagnetic actuators associated with corresponding print wires 22 for rapidly driving a selected wire upon energization of corresponding electromagnetic actuator. Each electromagnetic actuator has a yoke 76 with five magnetically interconnected poles 84, 86, 88, 92 and 96 and two electrically interconnected coils 100 and 102 surrounding poles 86 and 92 respectively. Each electromagnetic actuator includes an armature 74 biased against and pivoting about an outer pole 88 to move an inner end against a print wire when the coils 100 and 102 are concurrently energized with the same directional polarity. Coils 100 and 102 are separated by the center pole 84. The coil 102 has a smaller profile than the coil 100 and the armature 74 tapers from the outer end 104 to the inner end 108 to enable the electromagnetic drive elements to be angularly spaced about a center axis in a very compact relationship.

14 Claims, 8 Drawing Sheets

WIRE MATRIX PRINT HEAD ASSEMBLY

TECHNICAL FIELD

This invention relates to wire matrix print head assemblies classified in Class 400, subclass 124.

BACKGROUND OF THE INVENTION

For many years considerable effort has been directed at increasing the number of print wires in an assembly (package) to increase the resolution and throughput of printing and, at the same time, at configuring the printing elements so as to achieve higher velocity and frequency response.

Most of the commercially available wire matrix print head assemblies have been of a generally circular design in which the force generating elements such as electromagnets (solenoids) have been mounted in radial orientation about a central axis. Each electromagnet drive element generally has a single energizing coil mounted about one of the yoke poles for attracting a radially oriented armature in a pivotal motion about the yoke's outer (or inner) end. As the armature is pivoted, its inner end engages and drives a respective print wire from a retraced position to a forward, printing position.

The drawback of the usual single-coil configuration is that while the space in the peripheral area of the circular package is packed tightly, in order to keep the size of the package at the minimum (for a given number of actuators in a package), a vast area closer to the axis of the package remains virtually unused.

Attempts to improve the use of space in a package for generating useful energy have been made in some designs, in particular in wire print heads described in U.S. Pat. No. 4,382,701 of May 10, 1983, granted to Keith B. Davenport et al., and U.S. Pat. No. 4,218,148 of Aug. 19, 1980, granted to Arthur L. Matachka. A pair of radially spaced coils of a generally identical cross-sectional dimensions in each of the actuators is described in both of the patents. The coils are mounted next to each other on two adjacent limbs (poles) of the respective yokes. Though an additional coil in an actuator may contribute to some improvement of the print heads performance, the solution is far from ideal. For example, a two coil electromagnet, having a U-shaped core and a common to both poles armature, establishes a closed magnetic path requiring that the two coils have an opposite polarity. The opposite polarity means that the magnetic flux generated by the two coils in the space between them is mutually cancelled, resulting in a significant part of the supplied power being lost. Additionally, a dual-coil arrangement with the coils of a generally identical cross-sectional dimensions does not provide for a maximal usage of space in a package because the profile of the inner coils determines the maximum number of actuators that can fit in a package of a given diametrical size, or the size of a package with a given number of actuators. The outer coils inevitably are spaced apart much farther than they would be in a single coil arrangement, which means that a significant part of the space available in a package is lost.

It is the principal object of the present invention to provide a wire matrix print head assembly that dramatically increases the number of print wires for a high resolution and high throughput printing while minimizing the size of the package and increasing the impact force and the frequency response of the print wires.

Additionally, many wire matrix print head assemblies utilize O-rings engaging the ends of the armatures to facilitate both the pivotal motion of the armatures and shock absorption in their return stroke. Such O-rings, for example, are illustrated in U.S. Pat. No. 4,051,941 granted to Donald G. Hebert on Oct. 4, 1977. It has been found, however, that the O-rings transmit vibration from one armature to another circumventially, which impairs performance of the print heads. Attempts to partially overcome this problem by having individual shock absorbers for each armature, separately mounted on a common element of the structure, such as the armature retainer, are represented by U.S. Pat. No. 4,214,836 of July 29, 1980 granted to Cheng H. Wang and U.S. Pat. No. 4,382,701 to Keith B. Davenport et al., referred to above. The drawback of the individual, separately mounted shock absorber designs is high cost of manufacture and assembly of a number (up to 24, and more) of parts vs. a single part like an O-ring.

It is another object of the present invention to provide a highly efficient wire matrix print head assembly having low cost, easily manufactured and easily mounted elements facilitating the pivotal motion of the armatures and the shock absorption in their return stroke, without transmitting vibration from one armature to another.

These and other objects and advantages of this invention will become apparent upon reading the following detailed description of a preferred embodiment.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
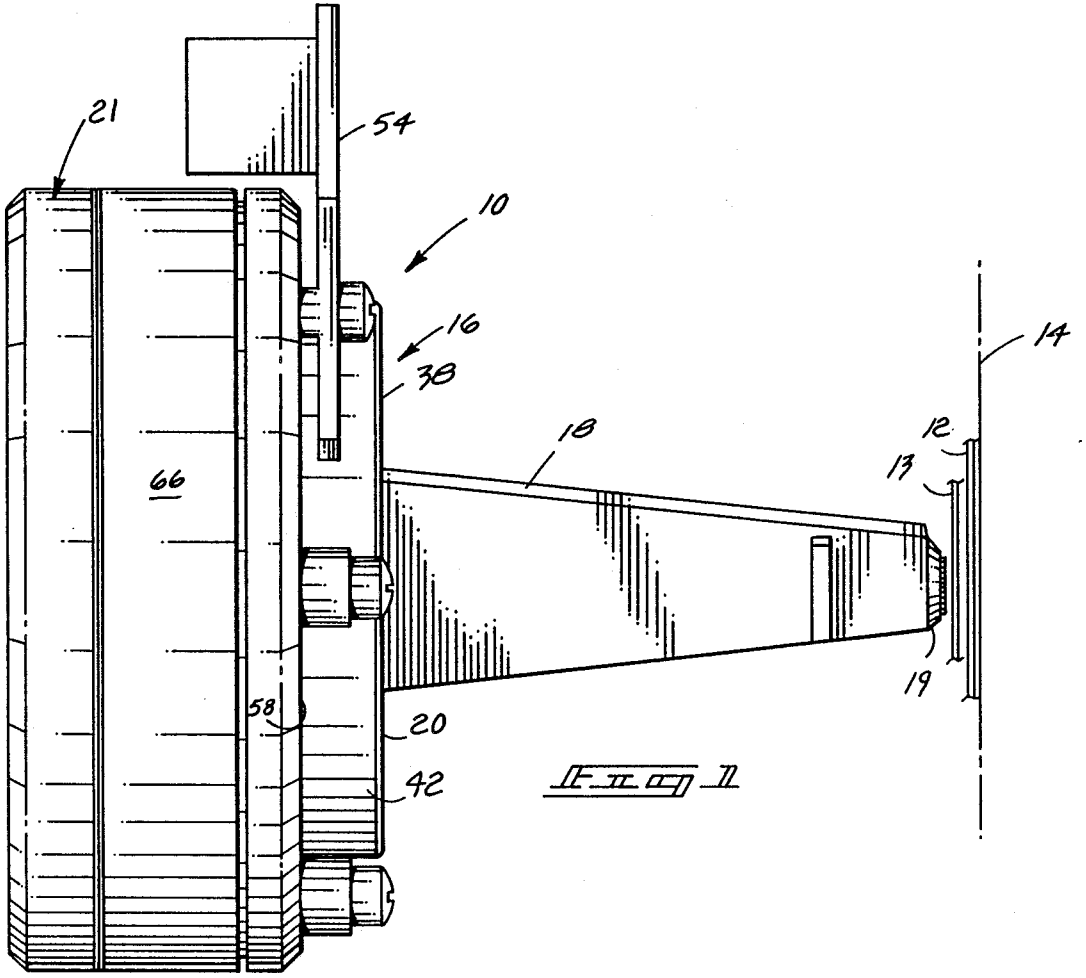
FIG. 1 is a side view of a preferred embodiment of the wire matrix print head assembly illustrating the print head assembly at a printing station for printing indicia from a ribbon onto a printing medium supported by a platen.

A preferred embodiment of the applicant's invention is illustrated in FIG. 1 and includes a wire matrix print head assembly generally designated with the numeral 10 for printing characters or graphic material on a print medium 12 such as paper. A ribbon 13 is interposed between the print medium and the print head assembly for providing the required ink. Generally the print medium 12 is supported by a print platen surface 14. Surface 14 can be a cylindrical surface or a flat surface. Such an arrangement is frequently used in a dot matrix computer printer in which the wire matrix print head assembly is moved transversely across the print medium for printing characters or graphic material as the print medium is being fed in a longitudinal direction.

Figure 4:
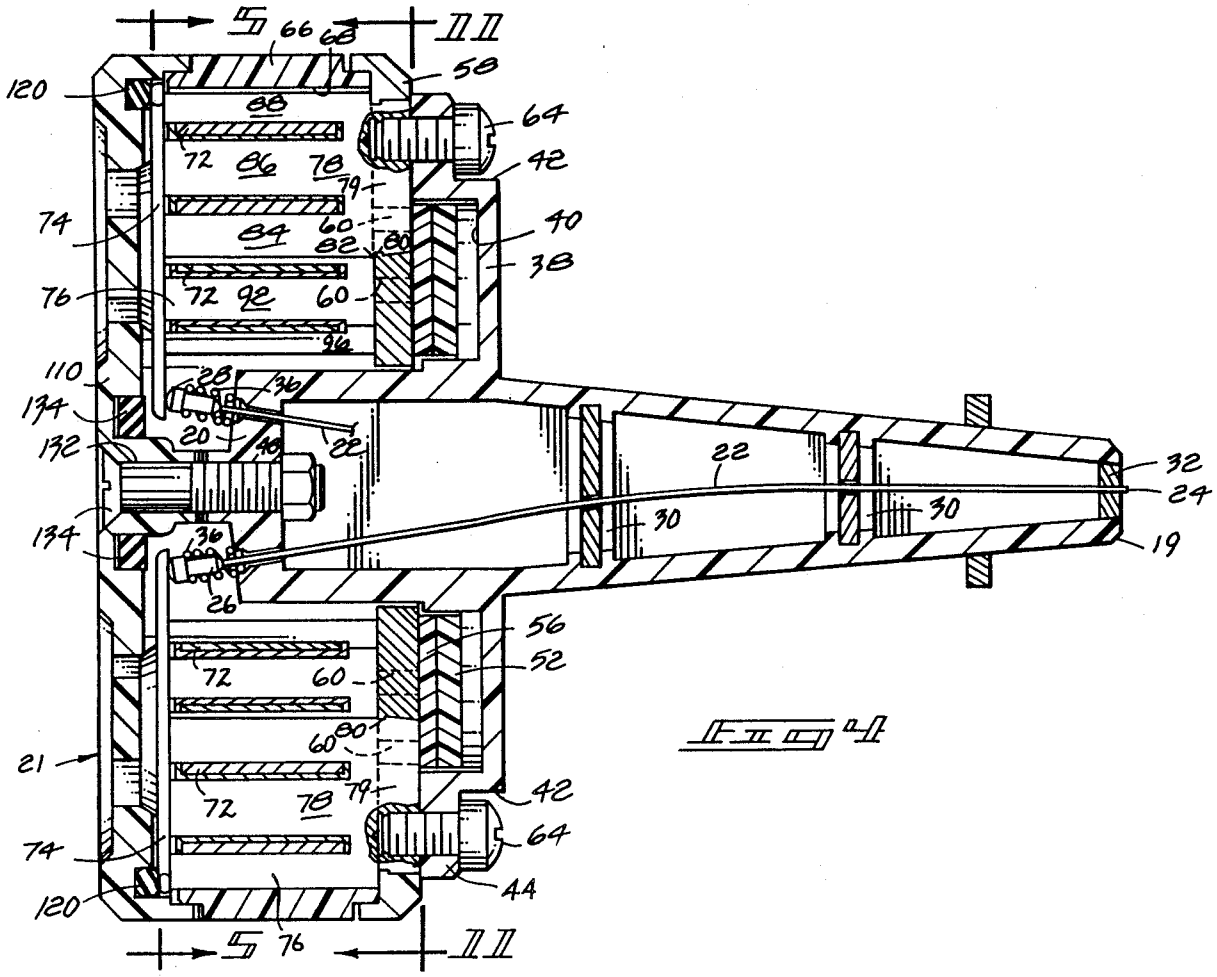
FIG. 4 is a cross-sectional view taken along lines 4—4 in FIG. 2 illustrating the interior of the head assembly with a wire element shown in the extended print position.

The wire matrix print head assembly 10 includes a housing generally designated with the numeral 16 that includes a wire support and guide housing section 18 that is elongated and extends from a forward end 19 to a rear end 20 (FIG. 4). The housing 16 further includes a wire drive housing section 21 that is connected to the wire support and guide housing section 18 for driving wire members 22 that are supported in the wire support and guide housing section 18.

The wire members 22 are elongated and extend from a print end or stylus 24 to a drive end 26. The wire members 22 are slidably mounted in the wire supporting guide housing section 18 for movement between a nonprint, retracted position and an extended print position with the print end or stylus 24 moving outward to impinge against the ribbon 13 to produce a dot on the print medium 12. Preferably the assembly 10 includes twenty four wire members that have a diameter at their print end 24 of approximately 0.010 inches to provide a very high resolution print format. Preferably the wire members 22, at the drive end, are oriented angularly with respect to each other at equal angular intervals about a central axis of the housing 16. In the embodiment shown the drive ends 26 are angularly spaced at 15° intervals. The drive end 26 has an enlarged head 28 that is particularly illustrated in FIGS. 4 and 6.

Figure 2:
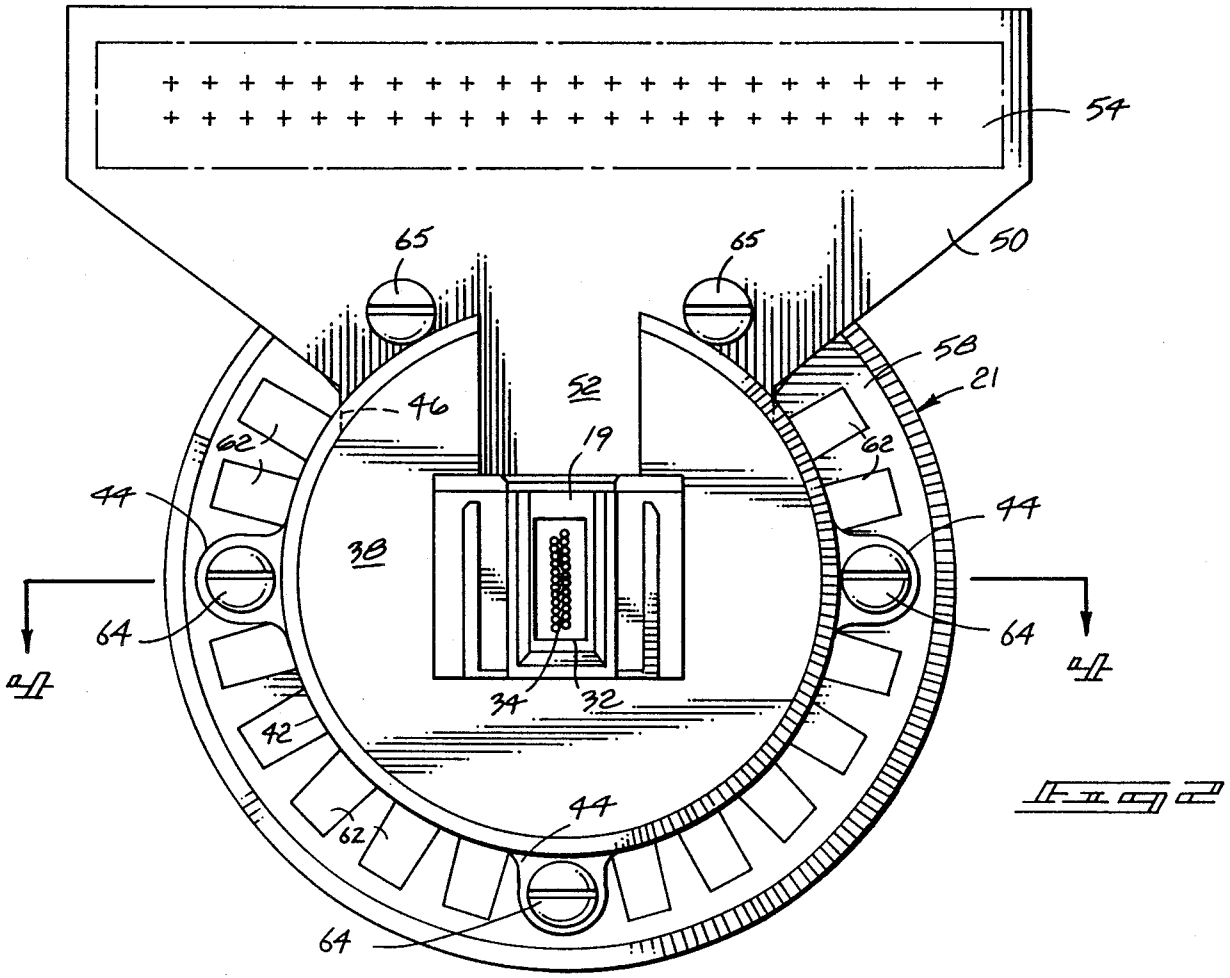
FIG. 2 is a front view of the wire matrix print head assembly illustrated in FIG. 1.
Figure 3:
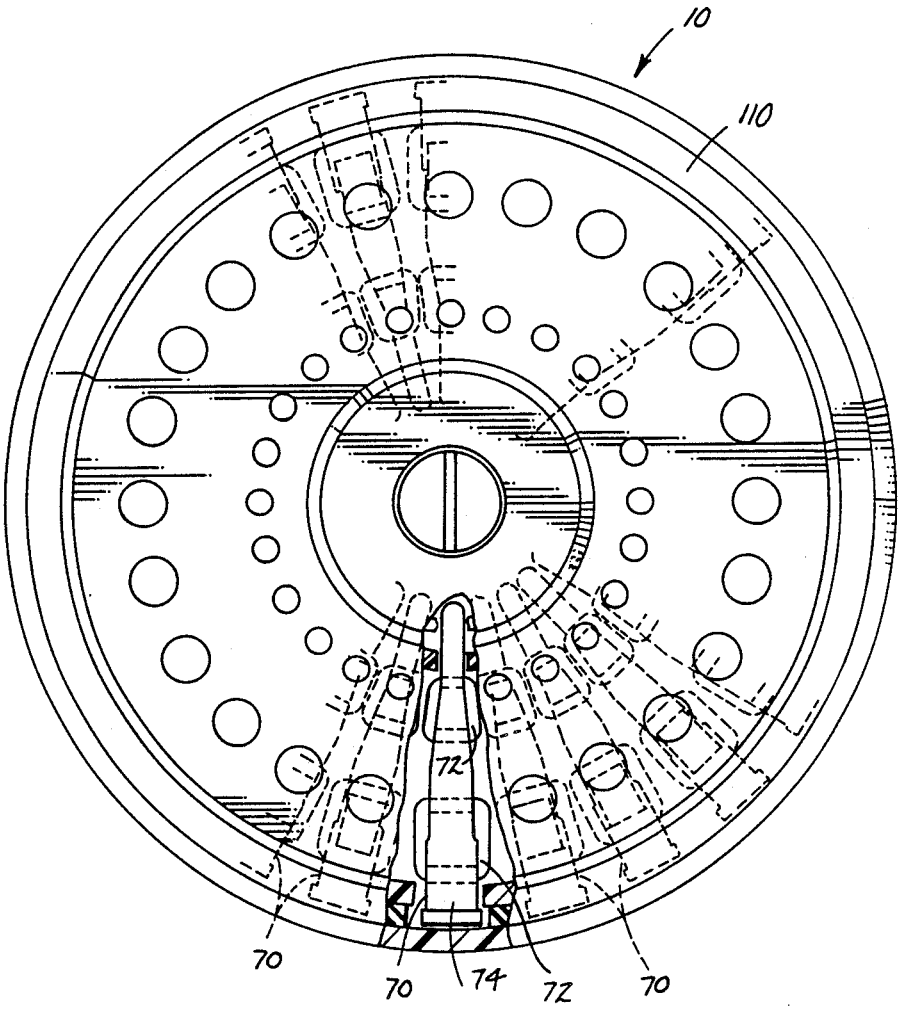
FIG. 3 is a rear view of the wire matrix print head assembly illustrated in FIGS. 1 and 2 with a portion of an armature retaining plate removed to illustrate, in solid line, one of a plurality of driving elements, with adjacent driving elements illustrated in dotted line.

The housing 18 includes wire guide members 30 (FIG. 4) for supporting the wire members between the drive end 26 and the print end 24. At the print end 24 the wire members 22 are supported by a wire bearing plate 32 that is illustrated in FIG. 2 having a double row of wire openings 34. Consequently, the wires 22 at the drive ends are oriented in a circular or elliptical array with the wire guide members 30 progressively bending the wires and bringing the wires closer together to form a desired pattern at the wire bearing plate 32. Preferably each wire member 22 has a spring 36 mounted adjacent the drive end 26 for biasing each of the wires from the extended print position to the non-print, retracted position.

The housing section 18 includes a radial mounting flange 38 that has an annular cup cavity 40 formed therein encircling the rear end portion 20 of the wire guide housing section 18. The flange 38 terminates in a cylindrical rim 42. Mounting lugs 44 extend outward from the rim 42 at angular spaced positions illustrated in FIG. 2. Additionally, the housing section 18 includes a segment slot 46 formed in the housing for receiving a printed circuit board 50. (FIG. 2) The housing section 18 further includes a mounting threaded bore 48 at rear end 20. (FIG. 4).

The printed circuit board 50 includes a ring 52 that fits within the annular cavity 40 as illustrated in FIG. 4, and a connector extension 54 (FIGS. 1 and 2) that extends outward from the ring 52 to provide for connecting the wire matrix print head assembly 10 electrically to control circuitry. An electrical insulation washer or ring 56 (FIG. 4) is mounted in the annular cavity 40 for insulating the printed circuit board 50 from the wire drive housing section 21.

Figure 11:
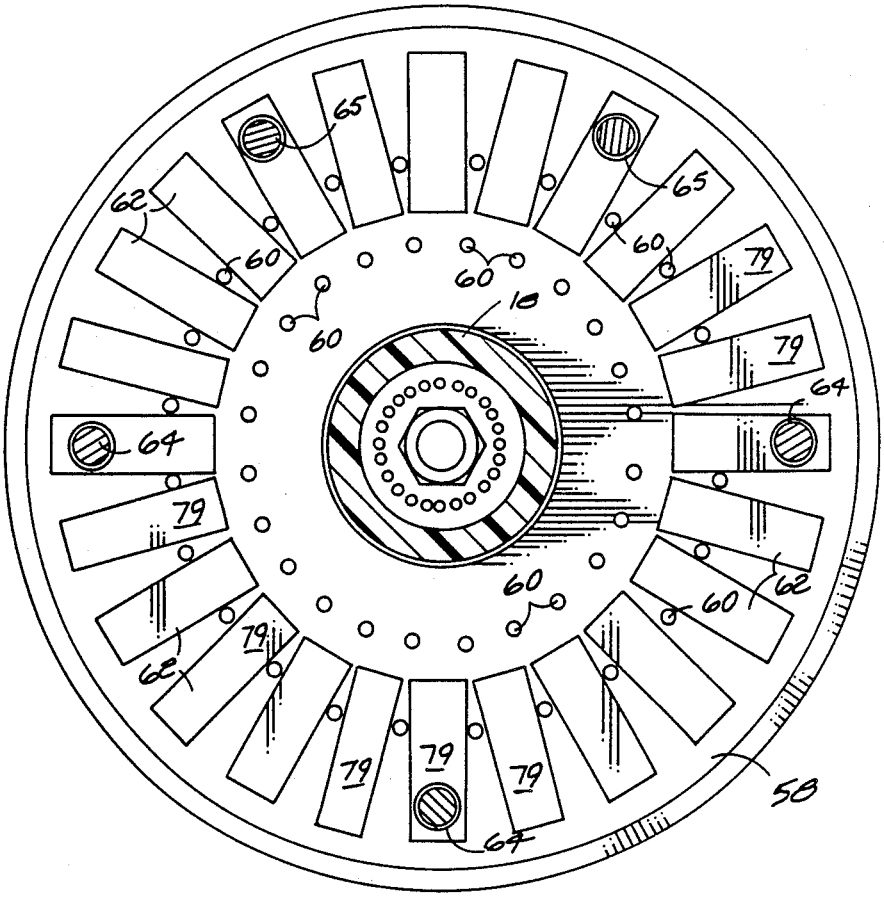
FIG. 11 is a cross-sectional view taken along line 11—11 in FIG. 4 illustrating the orientation of the electromagnetic elements.

The wire drive housing section 21 includes a circular ring-shaped base plate 58 that extends radially outward. The plate 58 has a plurality of wire passageways 60 (FIGS. 4 and 11) formed therein for enabling wire leads (not shown) to extend from the printed circuit board ring 52 to the interior of the housing section 21. Additionally, the base plate 58, as illustrated in FIG. 4, includes a plurality of angularly spaced yoke slots 62 formed therein at equal increments about the central axis. Mounting screws 64 are provided for attaching the wire support and guide housing section 18 at the mounting lugs 44 to the base plate 58, as illustrated in FIGS. 4 and 11. The housing 21 further includes a cylindrical wall 66 that extends axially rearward from the base plate 58 along the housing axis forming an annular cavity 68. Screws 65 attach the printed circuit board 50 to the base plate 58.

The assembly 10 importantly includes a plurality of electromagnetic drive means (actuators) that are radially spaced within the annular cavity 68 about the central axis for selectively driving the wire members 22 from the nonprint, retracted position to the extended print position. In the preferred embodiment, there is illustrated twenty four electromagnetic drive means that are angularly spaced about the central axis at 15° intervals.

Figure 6:
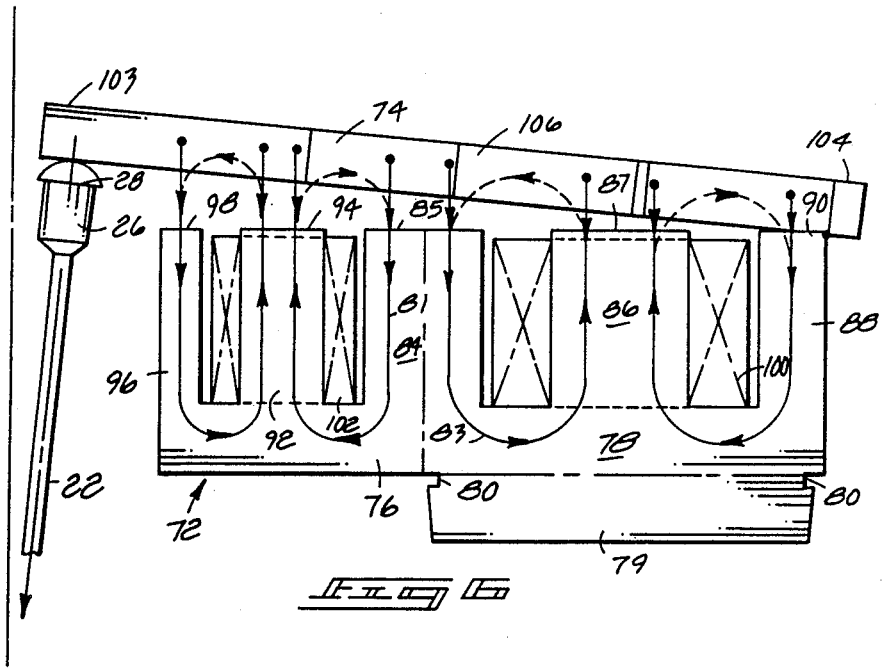
FIG. 6 is a fragmentary isolated view of a single electromagnetic driving unit illustrating an electromagnet assembly with an armature for driving a wire print element in which the figure illustrates magnetic flux lines through the poles of the electromagnet when the electromagnet is energized to drive a print wire from a non-print retracted position to an extended print position.

Each of the electromagnetic drive means (actuators) include an electromagnet 72 and an armature 74 (FIG. 6). The armatures 74 and the electromagnets 72 are aligned radially about the center axis. Each of the electromagnets 72 includes a pole yoke 76 (FIGS. 4 and 6) having a base 78 with a lug 79 that projects into the yoke slots 62 as illustrated in FIGS. 4 and 11. The lug 79 has notches 80 formed therein for locking with sides 82 of the slots 62 in the base plate 58 as illustrated in FIG. 4 to secure the yoke 76 to the base plate 58.

Figure 7:
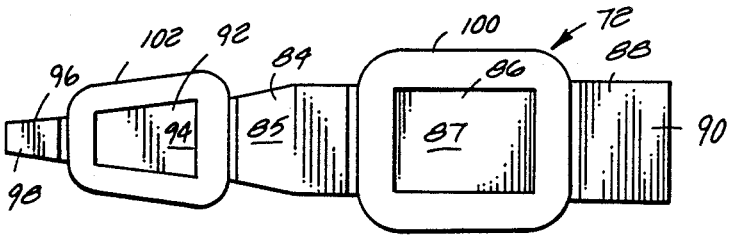
FIG. 7 is an isolated top view of the electromagnet illustrated in FIG. 6 with the armature removed to emphasize the location and profile of the electromagnet poles and coils.

Each of the pole yokes 76 includes a central pole 84 that extends perpendicular to the base 78 terminating in a central pole end surface 85. The pole yoke 76 has a first outer pole 86 that extends parallel with the pole 84 and spaced therefrom. The first outer pole 86 terminates in a pole end surface 87. The yoke 76 includes a second outer pole 88 that is likewise parallel and spaced from the first outer pole 86. The second outer pole terminates in a pole end surface 90. The pole yoke 76 has a first inner pole 92 that is parallel and spaced from the central pole 84 terminating in a pole end surface 94. The yoke 76 has a second inner pole 96 that is spaced inward radially from the first inner pole 92 and extends parallel with the first inner pole 92. The second inner pole 96 terminates in a pole end surface 98. Preferably each of the pole end surfaces 85, 87, 90, 94 and 98 lie in substantially the same plane, as illustrated in FIG. 6, for each is engaging the armature 74. The outermost edge of the pole end 90 serves as a pivot for the armature 74. As illustrated in FIG. 7, the inner poles 92 and 96 have tapered sides with smaller widths than the remaining poles 84, 86 and 88.

Each of the plurality of electromagnets 72 further includes an inner electrical coil 102 and an outer electrical coil 100 that are radially spaced from each other. The outer coil 100 fits over and circumscribes the outer pole 86 between the second outer pole 88 and the central pole 84. The inner coil 102 circumscribes the first inner pole 92 between the second inner pole 96 and the central pole 84 as illustrated in FIGS. 6 and 7. When the coils 100 and 102 are concurrently energized, they create the magnetic flux lines that are illustrated in FIG. 6 for attracting the armature 74 rapidly against the pole end surfaces 85, 87, 90, 94 and 98.

The dual-coil arrangement of the present invention with the center pole 84 taking up the space between the outer coil 100 and the inner coil 102, as illustrated in FIG. 6, eliminates the drawback of the dual-coil designs known in the art and referred to in the "Background of the Invention" section. Availability of a magnetic conductor—center pole 84—between the two coils allows to establish two separate closed magnetic paths 81 and 83 through the center pole 84. In this configuration, with the coils 100 and 102 having the same polarity, the magnetic flux induced in the center pole 84 by the two coils are additive, which eliminates loss of power attributed to the dual-coil arrangements known in the art, and boosts the efficiency and performance characteristics of the present invention.

Figure 5:
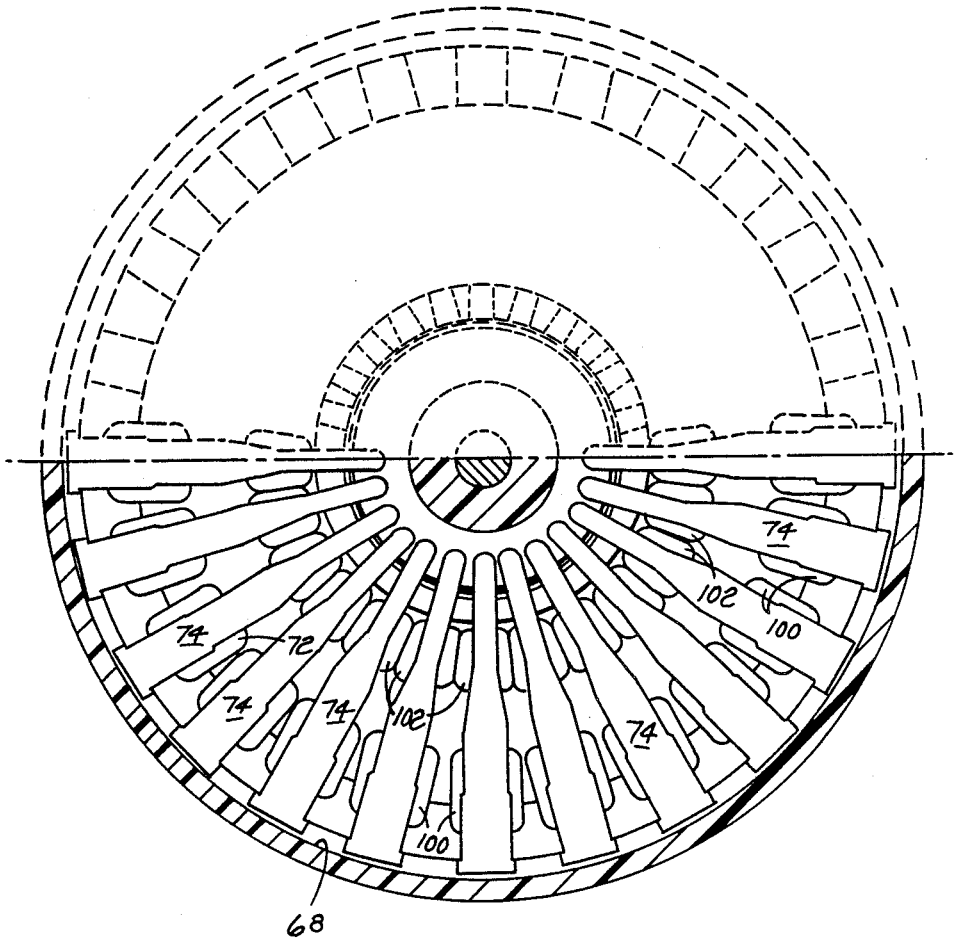
FIG. 5 is a cross-sectional view taken along line 5—5 in FIG. 4 illustrating a plurality of angularly spaced electromagnetic drive elements for driving the print wires about a center axis.

It should be noted that the outer coil 100 has a larger cross-section than the inner coil 102 in which the outer coil has more windings than the inner coil 102. Furthermore, the profile of inner coil 102 is smaller than that of the outer coil 100 so that the lateral dimension of the inner coil is smaller than the outer coil to provide a reduced profile, enabling each of the electromagnetic drive means (actuators) 70 to fit in the smallest possible sector about the central axis as illustrated in FIG. 5. Though the inner coil 102 is smaller and produces smaller magnetic forces, the lever arms of these forces, measured from the armature pivot line 91, are larger than those of the forces produced by the larger outer coil 100. This fact accounts for a significant contribution that the smaller inner coil 102 makes into the resultant force applied to the print wire 22.

Figure 8:
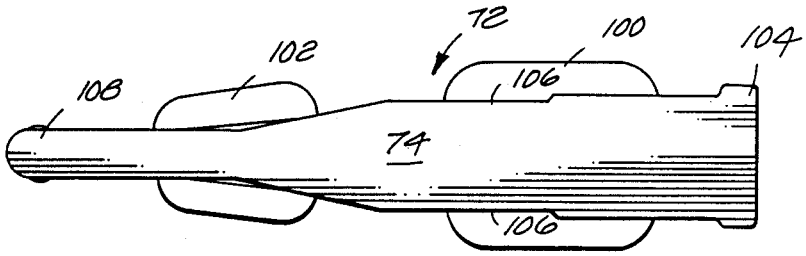
FIG. 8 is a top view similar to FIG. 7 except showing the location of the corresponding armature overlying the electromagnet illustrated in FIG. 7.

Each of the armatures 74 includes an outer end 104 that is "T" shaped that engages and pivots about an outer edge of the pole end 90 as illustrated in FIG. 6. Each of the armatures 74 extends from its outer end 104 to an inner end 108 that engages a respective drive end 26 of a wire member 22. Each of the armatures 74 has a progressively narrower width along sides 106 that extend from the outer end 104 to the inner end 108 as illustrated in FIGS. 6 and 8.

The wire drive housing section 21 further includes an armature retaining plate 110 (FIGS. 4, 9 and 10) that encloses the annular cavity 68 and supports the armatures in respective angular positions about the central axis. Although not shown in detail, the armature retaining plate 110 has conventional armature channels formed therein for receiving the armatures to permitting the armatures to pivot up and down as illustrated in FIG. 6 but preventing the armatures from moving laterally. The channels provide for angular alignment of the armatures 74 with the poles of the yoke 76 of each of the electromagnets 72.

Figure 9:
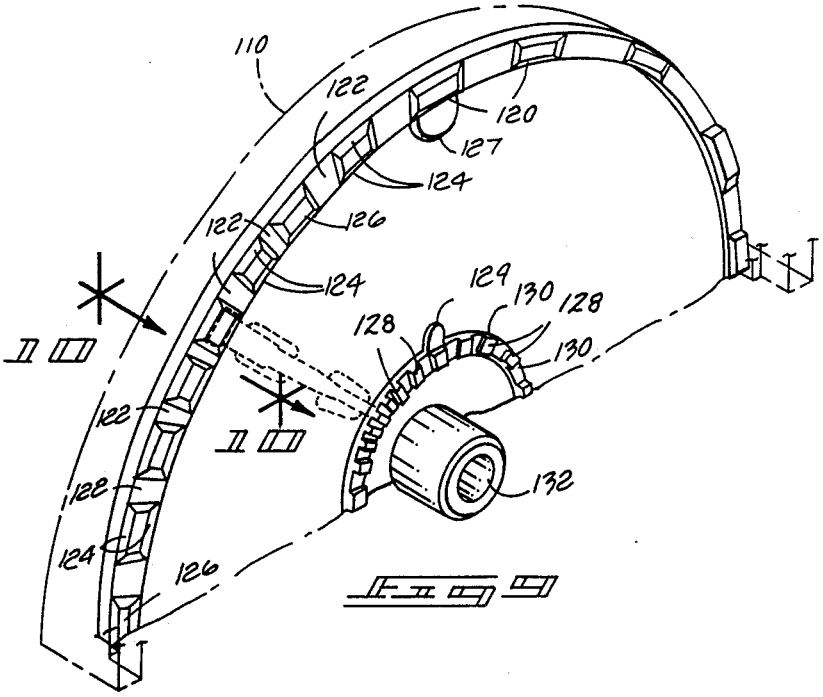
FIG. 9 is a fragmentary isolated perspective view of a portion of the inside of an armature retaining plate illustrating the configuration and location of an inner and outer shock absorbing elements for controlling and cushioning the movement of the armature.
Figure 10:
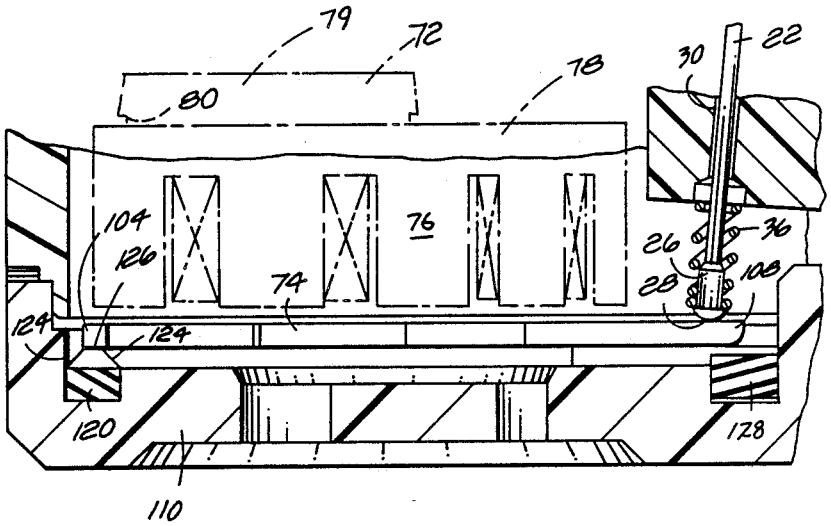
FIG. 10 is an isolated cross-sectional view taken along line 10—10 in FIG. 9 showing a single electromagnetic element illustrated in dotted line and the armature and shock absorbing elements in solid line.

The assembly 10 further includes resilient pivot pads 120 (FIGS. 9 and 10) that are associated with corresponding armature outer ends 104 for resiliently engaging the armature ends 104 and biasing the outer ends 104 against the pole ends 90 opposite the pole pivot edge. Each of the resilient pivot pads 120 is interconnected to adjacent pads by interconnecting webs 122. Such interconnection of the pads provides ease of manufacturing of the pads as a single, ring-shaped part, and easy mounting to groove formed in the armature retaining plate 110 as illustrated in FIGS. 9 and 10 while limiting the transmission of vibration from one armature to another. Each of the resilient pivot pads 120 includes inclined side walls 124 that neck down to provide a narrow engaging face 126 that engages the outer end 104 of the armature 74 to provide a resilient pivot opposite the rigid pole pivot edge. One of the resilient pivot pads 120 includes an annular alignment tab 127 that fits within a corresponding groove in the armature retaining plate 110 to angularly align the pads 120 with respect to the armatures and the electromagnets.

Additionally, the assembly 10 includes a plurality of shock absorbing cushions 128 mounted to the armature retaining plate 110 adjacent the inner ends 108 of the armatures to absorb the shock and cushion the inner ends 108 of the armatures, and through them the wire members 22, when the electromagnets are de-energized. The rebound cushions 128 have an interconnecting web 130 of a considerably lesser cross-section to prevent vibration of one cushion 128 from being transmitted to an adjacent cushion. Interconnecting web 130 provides for ease of manufacturing of the cushions as a single, ring-shaped part, and easy mounting and alignment of the cushions 128 relative to the armatures 74. One of the cushions 128 has an annular alignment tab 129 that fits into a corresponding groove in the armature retaining plate 110 to angularly align the cushions with the armatures.

The armature retaining plate 110 includes a bore 132 formed therein that is aligned with the threaded hole 48 of the wire support and guide housing section 18 to receive a screw 134 for holding the retaining plate to the housing 21. (FIG. 4) The screw 134 may be adjusted to vary the pressure of the resilient pivot pads 120 with respect to the outer ends 104 of the armatures.

The preferred embodiment provides for a print head assembly that has twenty four print wries and electromagnets for driving such print wires in a very compact space. Additionally, each electromagnet produces a force that is approximately one third greater than previous designs, which allows successful operation of the print head at a frequency approaching 2,500 Hz. In the past an increase in the number of print wires increased the size of the head or decreased the print wire velocity or both.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A wire matrix print head assembly having a plurality of elongated wire members in which each wire member is movable from a retracted nonprint position to an extended print position when a force is applied to a drive end of the wire member, comprising:

a housing having a central axis;

a plurality of armature means mounted at angularly spaced radial locations about the central axis of said housing with each armature means in operative association with the drive end of a corresponding wire member for selectively applying a force to the drive end of the corresponding wire member to selectively move the wire member from the retracted nonprint position to the extended print position;

a plurality of electromagnetic means associated with corresponding armature means with each electromagnetic means selectively applying magnetic forces to a corresponding armature means to selectively activate the armature means to drive the corresponding wire member to its extended print position;

each of the electromagnetic means having (1) a center pole and (2) a radially spaced first outer pole and (3) a radially spaced first inner pole that are magnetically interconnected in which the poles of each electromagnetic means have pole ends facing the corresponding armature means; and each of the electromagnetic means having an outer electrical coil surrounding the first outer pole and an inner electrical coil surrounding the first inner pole and separated by the center pole, in which the first inner and the outer coils are interconnected electrically with the same directional polarity to increase the force applied to the drive end of the wire member when the inner and outer coils are energized concurrently.

2. The wire matrix print head assembly as defined in claim 1 wherein the first outer electromagnetic pole has a greater transverse cross section than the first inner electromagnetic pole.

3. The wire matrix print head assembly as defined in claim 1 wherein the first outer electrical coil has an outer profile width that is greater than an outer profile width of the first inner electrical coil.

4. The wire matrix print head assembly as defined in claim 1 wherein each of the electromagnetic means is inscribed in an angular sector of 15° or less about the central axis.

5. The wire matrix print head assembly as defined in claim 1 wherein each of the electromagnetic means has a second outer pole spaced radially outward of the first outer pole with the outer electrical coil encircling the first outer pole between the center pole and the second outer pole.

6. The wire matrix print head assembly as defined in claim 1 wherein each of the electromagnetic means has a second inner pole radially spaced inward from the first inner pole with the inner electrical coil encircling the first inner pole between the center pole and the second inner pole.

7. The wire matrix print head assembly as defined in claim 1 wherein each of the electromagnetic means has a second outer pole radially spaced outward of the first outer pole and a second inner pole radially spaced inward from the first inner pole and wherein the outer electrical coil encircles the first outer pole between the center pole and the second outer pole and wherein the inner electrical coil encircles the first inner pole between the center pole and the second inner pole.

8. The wire matrix print head assembly as defined in claim 1 further comprising an armature retaining plate mounted to the housing for maintaining the armature means in the angularly spaced locations while enabling the armature means to pivot about pivot axes adjacent outer ends of the armature means and further comprising resilient pivot pads mounted to the armature retaining plate for engaging armature ends and biasing the engaged armatures against the corresponding poles at the pivot axes.

9. The wire matrix print head assembly as defined in claim 8 wherein the resilient pivot pads are interconnected by thinner resilient web sections.

10. The wire matrix print head assembly as defined in claim 8 wherein each of the resilient pivot pads has inclined side surfaces terminating in a thin face for engaging the outer ends of the armatures.

11. The wire matrix print head assembly as defined in claim 1 further comprising an armature retaining plate mounted to the housing for maintaining the armature means in the angularly spaced locations while enabling the armatures to pivot about pivot axes adjacent outer ends of the armatures and further comprising angularly spaced cushions mounted to the armature retaining plate adjacent inner ends of the armatures for limiting movement of the wire members in a rearward direction and absorbing shock caused by said movement.

12. The wire matrix print head assembly as defined in claim 11 wherein the angularly spaced cushions are interconnected by thinner resilient web sections.

13. A wire matrix print head assembly having a plurality of elongated wire members in which each wire member is movable from a retracted nonprint position to an extended print position when a force is applied to a drive end of the wire member, comprising:

a housing having a central axis;

a plurality of armature means mounted at angularly spaced radial locations about the central axis of said housing with each armature means in operative association with the drive end of a corresponding wire member for selectively applying a force to the drive end of the corresponding wire member to selectively move the wire member from the retracted nonprint position to the extended print position;

means for biasing each wire member to the retracted nonprint position;

a plurality of electromagnetic means associated with corresponding armature means with each electromagnetic means selectively applying magnetic forces to a corresponding armature means to selectively activate the armature means to drive the corresponding wire member from the retracted nonprint position to the extended print position;

a plurality of interconnected shock absorbing means mounted in a ring about the central axis with each shock absorbing means associated with a drive end of a wire member for cushioning the movement of the wire members to the retracted nonprint position; and said plurality of shock absorbing means being interconnected by web sections that have smaller cross section than that of the shock absorbing means to minimize the transfer of vibration between adjacent shock absorbing means.

14. The wire matrix print head assembly as defined in claim 13 wherein one of the shock absorbing means has an angular alignment tab formed thereon and wherein the housing has a groove formed therein for receiving the plurality of interconnected shock absorbing means in which the groove includes an alignment tab receiving section for receiving the angular alignment tab to angularly align the shock absorbing means with the wire members.

* * * * *